US010520221B2

(12) United States Patent
Shaw et al.

(10) Patent No.: US 10,520,221 B2
(45) Date of Patent: Dec. 31, 2019

(54) REFRACTORY FOR HEATING SYSTEM

(71) Applicant: Carrier Corporation, Farmington, CT (US)

(72) Inventors: Robert Shaw, Indianapolis, IN (US); Duane D. Garloch, Westfield, IN (US); Larry D. Rieke, Zionsville, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 141 days.

(21) Appl. No.: 15/091,745

(22) Filed: Apr. 6, 2016

(65) Prior Publication Data

US 2016/0290679 A1 Oct. 6, 2016

Related U.S. Application Data

(60) Provisional application No. 62/143,510, filed on Apr. 6, 2015.

(51) Int. Cl.

| | |
|---|---|
| ***F24H 9/20*** | (2006.01) |
| ***F28F 13/00*** | (2006.01) |
| ***F24H 3/06*** | (2006.01) |

(52) U.S. Cl.

CPC ..... *F24H 9/2085* (2013.01); *F24H 3/06* (2013.01); *F28F 13/00* (2013.01); *F28F 2013/001* (2013.01)

(58) Field of Classification Search

CPC ..... F24H 9/2085; F24H 3/06; F28F 2265/10; F28F 9/0221; F23D 14/62; F23D 14/64; F23D 14/70

USPC ..... 165/135; 126/99 R, 110 R, 109, 114, 126/99 A, 99 C; 431/178, 181, 174

See application file for complete search history.

(56) References Cited

U.S. PATENT DOCUMENTS

| | | | | | |
|---|---|---|---|---|---|
| 4,938,283 | A * | 7/1990 | Wood | F23C 5/00 | 126/104 R |
| 5,180,302 | A * | 1/1993 | Schwartz | F23D 14/00 | 431/175 |
| 5,244,381 | A * | 9/1993 | Cahlik | F23M 9/06 | 126/116 R |
| 5,346,002 | A | 9/1994 | Swilik, Jr. et al. | | |
| 5,379,751 | A * | 1/1995 | Larsen | F24H 3/105 | 126/110 A |

(Continued)

FOREIGN PATENT DOCUMENTS

| | | | | |
|---|---|---|---|---|
| GB | 334795 | A * | 9/1930 | F28D 7/1623 |
| WO | 2011070070 | A2 | 6/2011 | |

OTHER PUBLICATIONS

Bekaert, [online]; [retrieved on Mar. 12, 2018]; retrieved from the Internet https://heating.bekaert.com/en/combustion-technology/product-solutions/premix-bumer-solutions/furipat-refractory-cylindrical-premix Bekaert, "Furipat Refractory Cylindrical Premix," Bekaert SA, 2014, pp. 1-1.

*Primary Examiner* — Avinash A Savani
*Assistant Examiner* — Rabeeul I Zuberi
(74) *Attorney, Agent, or Firm* — Cantor Colburn LLP

(57) ABSTRACT

A refractory panel for a heat exchanger is provided having a body including a first planar surface having a plurality of refractory openings formed therein. A sidewall is arranged about a periphery of at least one of the plurality of refractory openings. The sidewall extends outwardly from the first planar surface and is configured to extend through an adjacent component into an inlet of a heat exchanger coil.

14 Claims, 7 Drawing Sheets

(56) References Cited

U.S. PATENT DOCUMENTS

| | | | | |
|---|---|---|---|---|
| 5,441,405 | A * | 8/1995 | Bedford | F23D 14/045 126/110 C |
| 6,123,542 | A | 9/2000 | Joshi et al. | |
| 6,276,924 | B1 | 8/2001 | Joshi et al. | |
| 6,474,329 | B1 * | 11/2002 | Sears | F24H 3/105 126/110 A |
| 6,540,508 | B1 | 4/2003 | Simpson et al. | |
| 6,780,005 | B2 | 8/2004 | Kessler | |
| 6,991,454 | B2 | 1/2006 | Gore et al. | |
| 7,163,392 | B2 | 1/2007 | Feese et al. | |
| 7,766,649 | B2 | 8/2010 | Abbasi et al. | |
| 8,105,076 | B2 | 1/2012 | Turner et al. | |
| 8,167,610 | B2 | 5/2012 | Raleigh et al. | |
| 8,297,969 | B2 | 10/2012 | Daneri et al. | |
| 8,367,032 | B2 | 2/2013 | Alford et al. | |
| 8,616,194 | B2 * | 12/2013 | Sherrow | F24H 9/14 126/110 A |
| 8,920,160 | B2 | 12/2014 | Mozzi et al. | |
| 2006/0246387 | A1 | 11/2006 | Smirnov | |
| 2010/0104990 | A1 | 4/2010 | Sarmiento-Darkin et al. | |
| 2011/0146450 | A1 | 6/2011 | Docquier et al. | |
| 2012/0240917 | A1 * | 9/2012 | Tolleneer | F24H 3/087 126/116 R |
| 2013/0203003 | A1 | 8/2013 | Cain et al. | |
| 2013/0302737 | A1 | 11/2013 | Schultz et al. | |
| 2014/0011152 | A1 | 1/2014 | Maekawa et al. | |
| 2014/0093830 | A1 | 4/2014 | St Louis | |
| 2014/0272735 | A1 | 9/2014 | Newby | |

* cited by examiner

REFRACTORY FOR HEATING SYSTEM

CROSS-REFERENCE TO RELATED APPLICATIONS

This application claims the benefit of U.S. provisional patent application Ser. No. 62/143,510, filed Apr. 6, 2015, the entire contents of which are incorporated herein by reference.

BACKGROUND

The subject matter disclosed herein relates to heating systems. More specifically, the subject disclosure relates to burners for residential and commercial heating systems.

Heating systems, in particular furnaces, include one or more burners for combusting a fuel such as natural gas. Hot flue gas from the combustion of the fuel proceeds from the burner and through a heat exchanger. The hot flue gas transfers thermal energy to the heat exchanger, from which the thermal energy is then dissipated by a flow of air driven across the heat exchanger by, for example, a blower.

A typical construction is shown in FIG. 1. A burner 100 is located external to a heat exchanger 102. The burner 100, referred to as an inshot burner 100, receives a flow of fuel from a fuel source 104. An ignition source 106 combusts the flow of fuel. Even though the inshot burner 100 is in close proximity to heat exchanger 102, surfaces of the heat exchanger 102 adjacent to the combustion flame 110 are kept relatively cool by a flow of secondary air 108 to prevent damage to the surfaces of the heat exchanger 102 via the combustion flame 110.

Another type of burner is a premix burner in which fuel and air are mixed in the burner nozzle prior to injection into a combustion zone 112 where the ignition source 106 ignites the mixture. Premix burners, compared to inshot burners, typically emit much lower levels of $NO_x$, the emissions of which are tightly regulated and restricted in many jurisdictions. Because of this typical advantage of premix burners, it is often appealing to introduce premix burners into furnaces. However, a premix burner having physical and operating characteristics similar to the burner 100 may not be suitable for use with heat exchanger 102. The heat exchanger walls and cell panel 103 would necessarily be in close proximity to the burner and thus the concentration of heat produced in the immediate vicinity of the burner would typically result in excessively high temperatures in the wall of the heat exchanger 102 and cell panel 103. Such high temperatures would typically increase the surface temperatures of the surrounding heat exchanger 102 and cell panel 103 and, thereby, may shorten the life of the heat exchanger 102 and cell panel 103. Further, premix burners typically have a much quicker heat release than inshot burners and generally do not have the benefit of secondary airflow to cool the heat exchanger surfaces and, thereby, protect them from damage. Thus, simply replacing inshot burners with premix burners in an existing furnace construction would typically result in excessively high temperatures at adjacent heat exchanger surfaces.

BRIEF DESCRIPTION

According to one embodiment, a refractory panel for a heat exchanger is provided having a body including a first planar surface having a plurality of refractory openings formed therein. A sidewall is arranged about a periphery of at least one of the plurality of refractory openings. The sidewall extends outwardly from the first planar surface and is configured to extend through an adjacent component into an inlet of a heat exchanger coil.

In addition to one or more of the features described above, or as an alternative, in further embodiments the at least one sidewall is integrally formed with the first planar surface.

In addition to one or more of the features described above, or as an alternative, in further embodiments the body and at least one sidewall are formed via a vacuum molding process.

In addition to one or more of the features described above, or as an alternative, in further embodiments a size and shape of the refractory panel is generally complementary to the adjacent component.

In addition to one or more of the features described above, or as an alternative, in further embodiments the geometry of each refractory opening and sidewall is selected to encourage fluid flow towards the heat exchanger inlet.

In addition to one or more of the features described above, or as an alternative, in further embodiments the refractory panel is formed from a material configured to withstand a temperature of at least about 2300° F.

According to yet another embodiment, a furnace is provided including a heat exchanger including a plurality of coils and a burner assembly. The burner assembly includes one or more burners disposed at and substantially aligned with one or more burner openings of the heat exchanger. A partition plate includes one or more partition openings substantially aligned with the one or more openings of the heat exchanger. An inner box of the burner assembly includes one or more cell openings substantially aligned with the one or more partition openings. An inlet end of one or more of the heat exchanger coils is arranged in contact with a surface of the inner box. A refractory panel is arranged generally between the partition plate and the inner box. The refractory panel includes one or more refractory openings substantially aligned with the one or more partition openings and cell openings. A sidewall arranged about a periphery of the one or more refractory openings extends through an adjacent cell opening.

In addition to one or more of the features described above, or as an alternative, in further embodiments the sidewall extends into the inlet end of a heat exchanger coil.

In addition to one or more of the features described above, or as an alternative, in further embodiments the sidewall is integrally formed with a first planar surface of the refractory panel.

In addition to one or more of the features described above, or as an alternative, in further embodiments the refractory panel is formed via a vacuum molding process.

In addition to one or more of the features described above, or as an alternative, in further embodiments the refractory panel is received within a cavity of the inner box. The refractory panel has a size and shape generally complementary to the cavity.

In addition to one or more of the features described above, or as an alternative, in further embodiments a geometry of the one or more refractory openings and sidewalls is selected to encourage fluid flow towards the inlet end of the heat exchanger coils.

In addition to one or more of the features described above, or as an alternative, in further embodiments the refractory panel is formed from a material configured to withstand a temperature of at least about 2300° F.

In addition to one or more of the features described above, or as an alternative, in further embodiments the one or more burners are configured to pre-mix fuel and air before ignition thereof.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION

Figure 1:
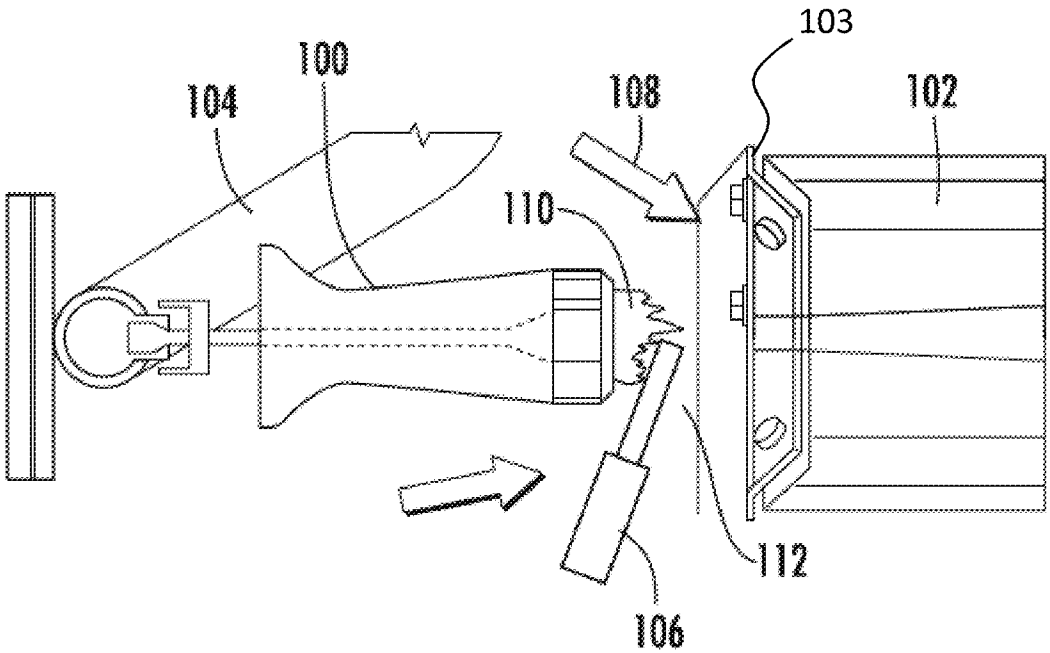
FIG. 1 PRIOR ART
FIG. 1 is a cross-sectional view of an example of a typical prior art burner arrangement.
Figure 2:
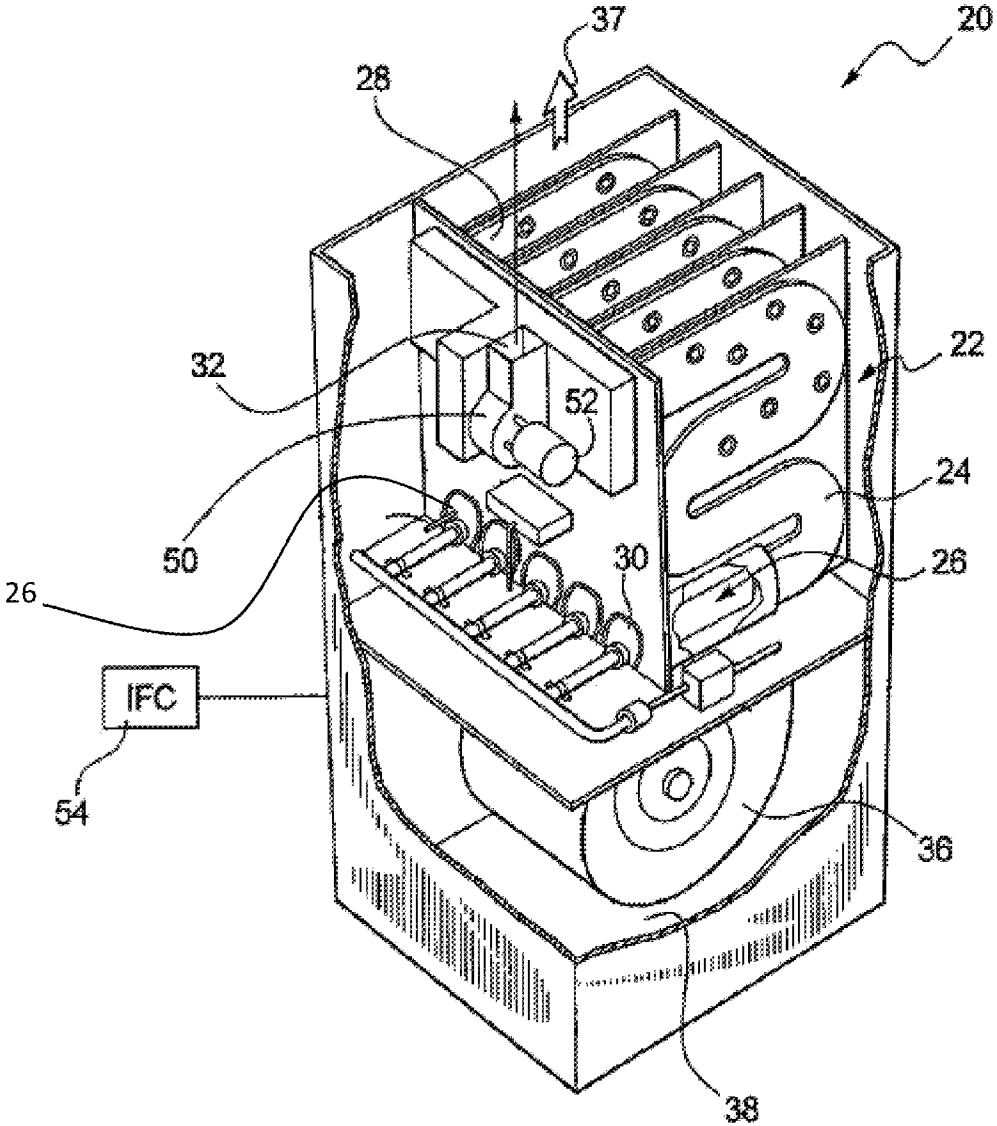
FIG. 2 is a schematic view of an embodiment of a furnace.

Referring now to FIG. 2, an improved furnace 20 is illustrated. The furnace 20 may include a heat exchanger 22 having a plurality of individual heat exchanger coils 24. The heat exchanger coils 24, which may be metallic conduits, may be provided in a serpentine fashion to provide a large surface area in a small overall volume of space, the importance of which will be discussed in further detail below. Each heat exchanger coil 24 includes an inlet 26 and outlet 28. A burner 30 is operatively associated with each inlet 26, and a vent 32 is operatively associated with each outlet 28. The burner 20 introduces a flame and combustion gases (not shown) into the heat exchanger coil 24, while vent 32 releases the combustion gases to atmosphere (through a flue or the like) after the heat of the flame and combustion gases is extracted by the heat exchanger 22.

In order to extract the heat, a blower motor 36 may be provided to create a significant air flow across the heat exchanger coils 24. As the air circulates across the coils 24, it is heated and can then be directed to a space to be heated such as a home or commercial building for example, by way of appropriate ductwork as indicated by arrow 37. The furnace 20 may also include a return 38 to enable air from the space to be heated to be recirculated and/or fresh air to be introduced for flow across the heat exchanger coils 24.

To generate the flame and hot combustion gases, the burners 30 pre-mix fuel and air and then ignite the same. The fuel may be natural gas or propane and may be introduced by a fuel orifice or jet 42 (FIG. 4) positioned at an inlet of the burner inlet tube 63. The burner 30 includes a burner tube 61 having an inlet 60 and an outlet 48. A portion or substantially all of the air and fuel for combustion is introduced into the burner 30 through inlet 60. Such air may be introduced by inducing an airflow using a motorized induction fan 50 downstream of the burner outlet 48. More specifically, a motor 52 having the fan 50 associated therewith may be operatively associated with the outlets 28 of the heat exchanger coils 24. When energized, the fan 50 may rotate and induce an air flow through the heat exchanger coils 24 and burners 30. Control of the motor 52, may be controlled by a processor 54 such as an integrated furnace control (IFC).

Figure 3:
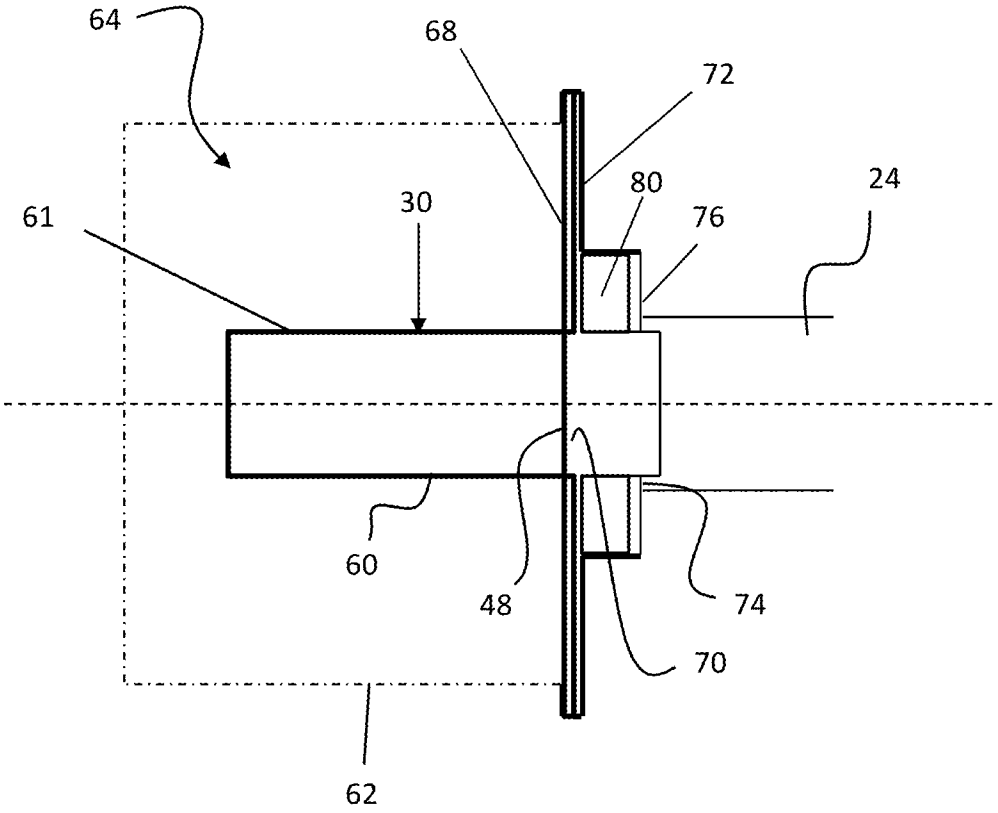
FIG. 3 is a cross-sectional view of a burner box according to an embodiment of the invention.
Figure 4:
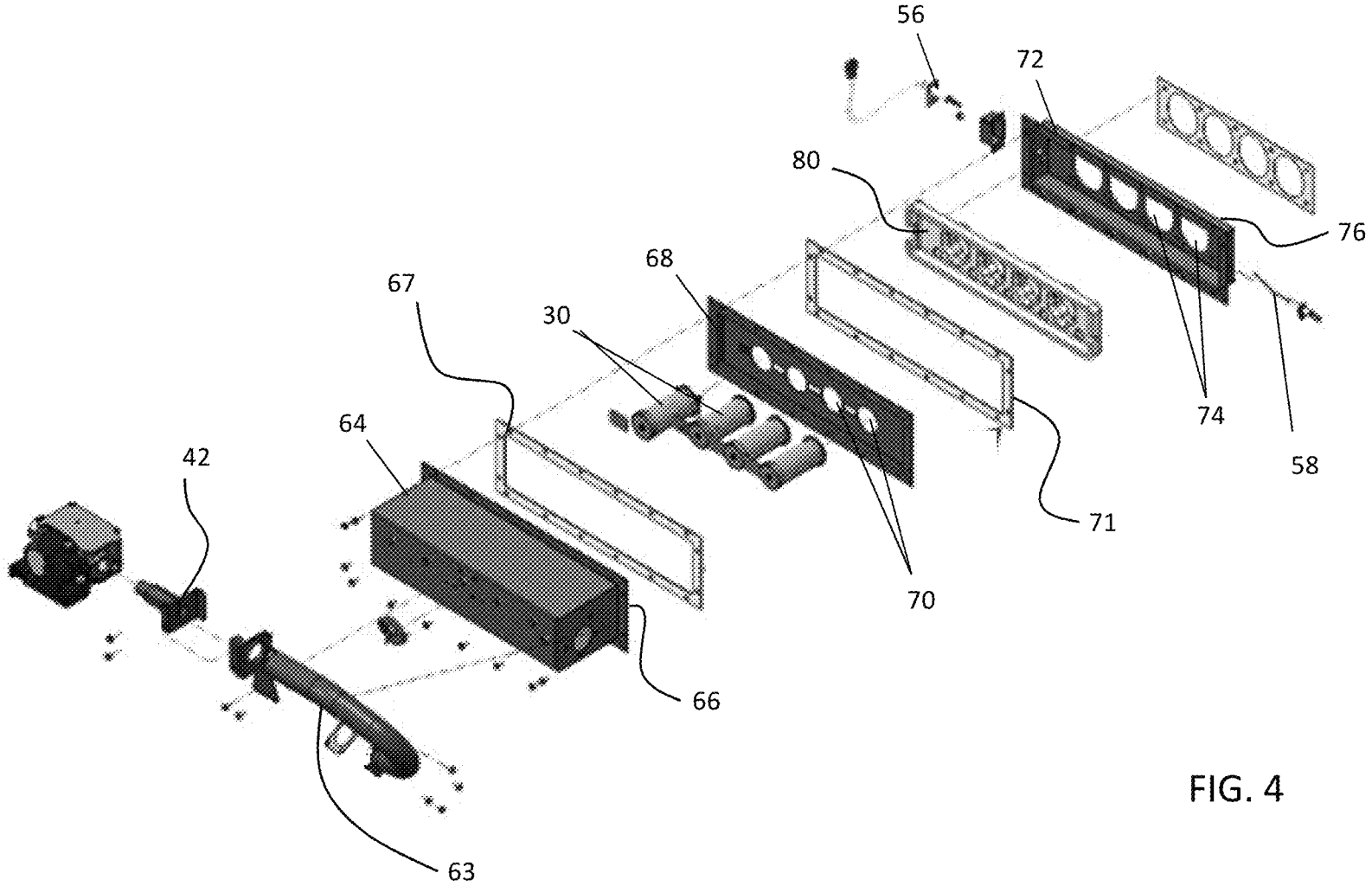
FIG. 4 is an exploded view of a burner box according to an embodiment of the invention.

Referring now to FIGS. 3-4, the burners 30 are illustrated in more detail. As indicated above, each burner 30 includes a burner tube 61 having an inlet 60 and an outlet 48, but can be provided in other configurations as well. For example, while depicted as a cylindrical tube of constant diameter, the burner tube 61 may be provided as a restricted diameter section or a venturi, among other variations.

Each or all of the plurality of burners 30 may be arranged within a mixing chamber 64 within which fuel supplied by the fuel jet 42 and air A drawn by inducer fan 50 are premixed prior to ignition. The burners 30 may additionally include a mixer (not shown) which is used to decrease lean blow-off and increase the stability of the flame. To light the burners 30, at least one igniter 56 (see FIG. 4) is located near the burners 30, generally between the burner outlet 48 and the heat exchanger 22 to ignite the fuel/air mixture. Similarly, a flame sensor 58 generally aligned with the igniter 56, may be disposed on an opposite side of the burners 30 than the igniter 56. The flame sensor 58 is configured to determine if the ignition has carried over to each of the plurality of burners 30 by sensing the presence of a flame at the burner 30 furthest from the igniter 56.

Each of the burners 30 is positioned within a hollow interior 64 of an outer box 62 such that the outlet 48 of the burner 30 is adjacent an open end 66 of the box 62. Connected to the open end 66 of the box 62 and the outlet end 48 of each of the plurality of burners 30 is a partition plate 68. A gasket 67 may be arranged between a portion of the open end 66 of box 62 and the partition plate 68 to provide a seal there between. The partition plate 68 has a plurality of openings 70 formed therein, each of which is substantially aligned with and fluidly coupled to the outlet 48 of a corresponding burner 30. In another embodiment, a portion of the burner tubes 61 may extend through the openings 70 formed in the partition plate 68.

An inner box 72 is coupled to the partition plate 68, opposite the outer box 62. A gasket 71 may similarly be arranged between a portion partition plate 68 and the inner box 72 to form a seal there between. In an embodiment, the inner box 72 may be integrated with the partition plate 68. The inner box 72 also includes a plurality of openings 74, each of which is substantially aligned with and fluidly coupled to an opening 70 formed in the partition plate 68 and the outlet 48 of a corresponding burner 30. The individual heat exchanger coils 24 are positioned adjacent an exterior surface 76 of the inner box 72, such as to a cell panel (not shown) mounted thereto, in line with the plurality of openings 74, such that a fluid flow path extends from the burner outlet 48 through the partition plate 68 and inner box 72 into the heat exchanger coils 24.

Figure 5:
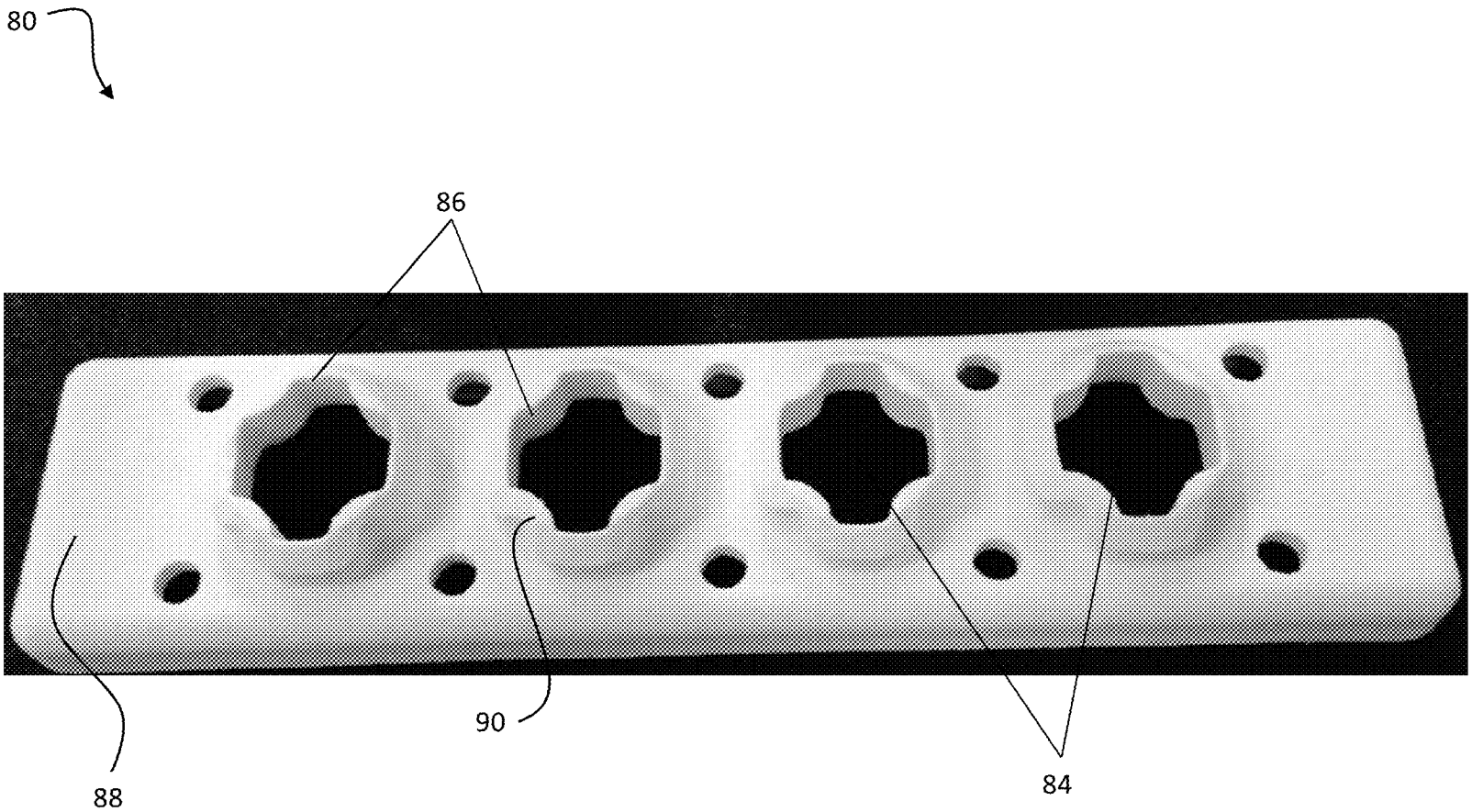
FIG. 5 is a rear perspective view of a refractory panel of the burner box according to an embodiment of the invention.
Figure 6:
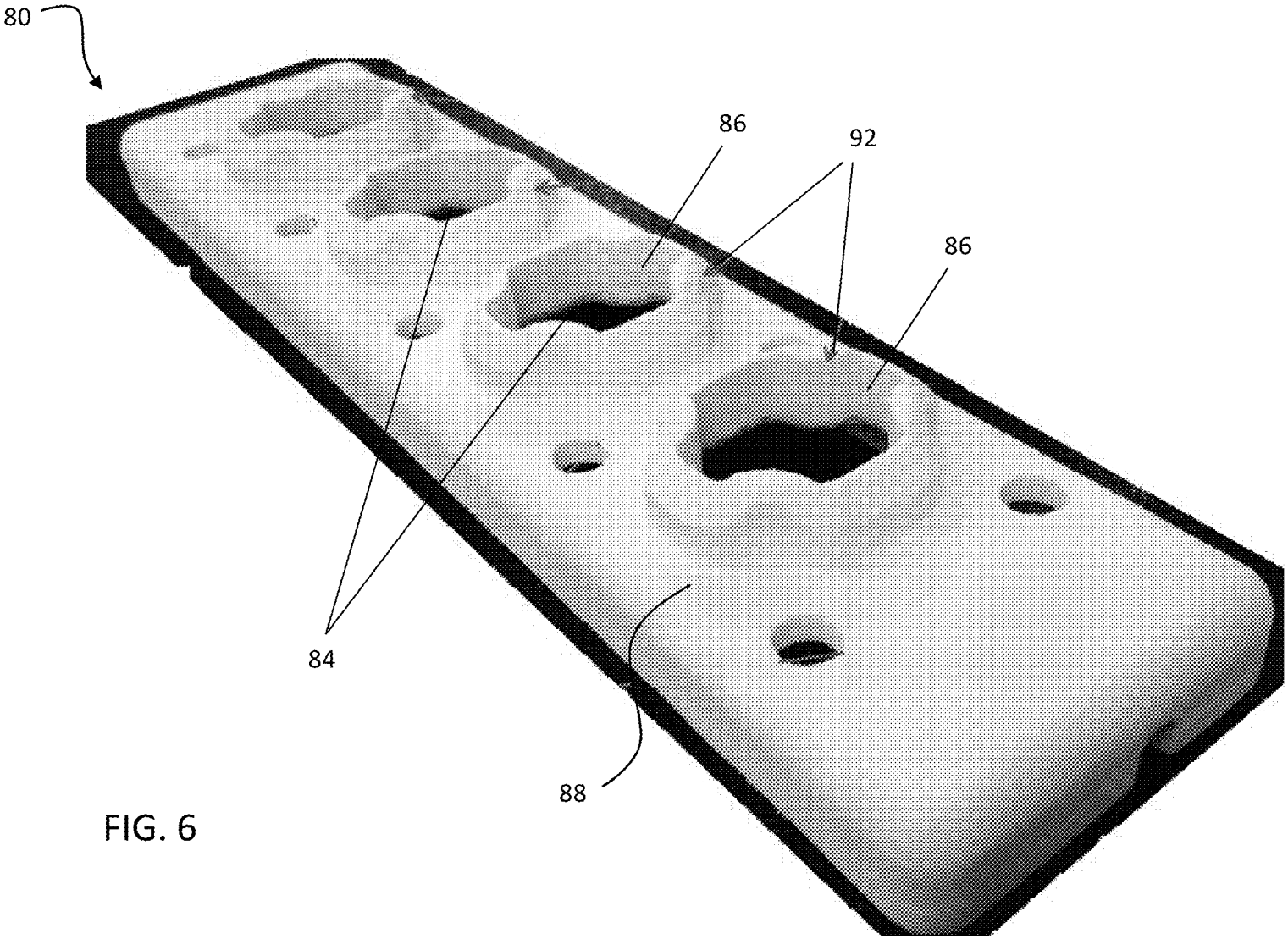
FIG. 6 is a side perspective view of a refractory panel of the burner box according to an embodiment of the invention.
Figure 7:
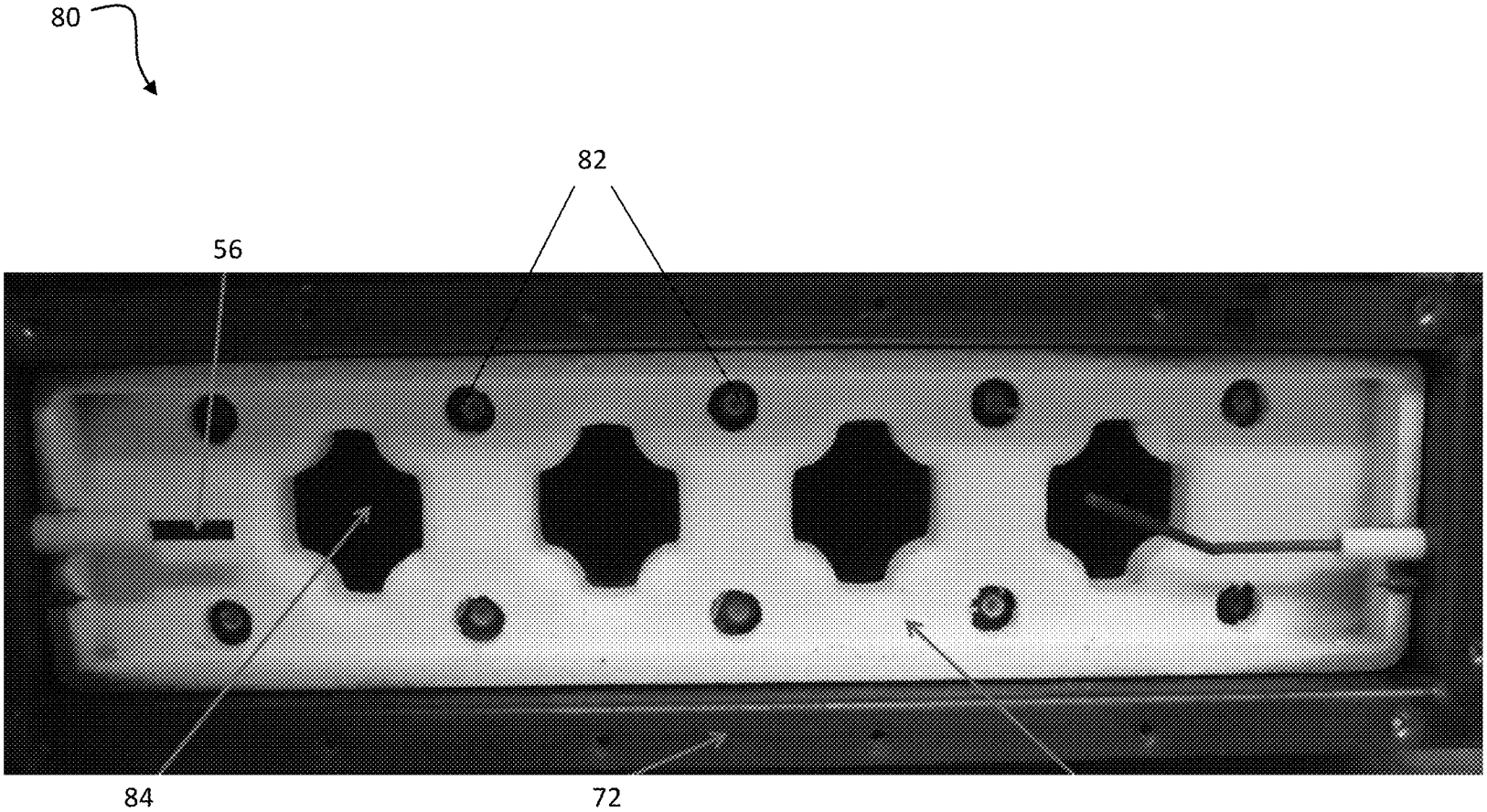
FIG. 7 is a front perspective view of a refractory panel of the burner box according to an embodiment of the invention.

A refractory panel 80, illustrated in more detail in FIGS. 5-7, is, in an embodiment disposed between a portion of the partition plate 68 and the inner box 72. The inner box 72 may be a plate and the refractory panel 80 may overlay a portion or the entire inner box 72. Alternatively, as shown in the non-limiting embodiment illustrated in the FIGS., the refractory panel 80 may be received within a cavity 78 formed in the inner box 72. In such embodiments, the refractory panel 80 has a size and shape generally complementary to the cavity 78.

The refractory panel 80 is configured to removably couple to the inner box 72, such as with a plurality to fasteners 82 for example. In an alternative embodiment, the refractory panel 80 may be permanently attached to the inner box 72 or integrally formed with the inner box 72. As shown in FIGS. 4-7, the refractory panel 80 includes a plurality of refractory openings 84 arranged coaxially with the plurality of partition openings 70 and plurality of cell openings 74 about a central burner axis X. A sidewall 86 formed about each of the refractory openings 84, extends outwardly, for example perpendicularly, from a first planar surface 88 of the refractory panel 80. In addition, the distal end 90 of each sidewall 86 may include a feature 92 (FIG. 6), such as an angle, radius, or chamfer for example. In one embodiment, the refractory panel 80 and sidewall 86 extending therefrom are integrally formed, such as via an injection molding or vacuum molding process for example.

When mounted to the inner box 72, the back surface 88 of the refractory panel 80 contacts an adjacent surface of the inner box 72. As a result, the sidewalls 86 of the refractory panel 80 extend through the adjacent cell openings 74, generally beyond the surface 76 of the inner box 72. In one embodiment, the sidewalls 86 extend into the inlet end 26 of the adjacent heat exchanger coils 24. Therefore, the geometry of each opening 84 and sidewall 86 is selected to encourage fluid flow towards the heat exchanger 22. In the illustrated, non-limiting embodiment, the cell openings 74 are generally circular in shape. However, a portion of the sidewall 86 directly adjacent an opening 74 configured to receive a fastener curves inwardly towards the center of the opening 74 to provide an increased clearance thereby increasing the ease of installing and removing the fasteners. The shape of the openings 74 and sidewalls 86 illustrated and described herein are intended as examples, and it should be understood that a variety of configurations are within the scope of the invention.

Because the refractory panel 80 is exposed to the burner flames, in an embodiment, the refractory panel 80 is formed from a heat resistant material, such as a ceramic or plastic for example. In one embodiment, the refractory panel 80 is configured to withstand temperatures up to and exceeding 2300° F. By positioning the refractory panel 80 between the inner box 1 72 and the burner flames, the refractory panel 80 may protect not only the adjacent surface of the inner box 72, but also the interface between the inner box 72 and the heat exchanger coils 24, from overheating. Therefore, the structure disclosed herein allows for the utilization of a premix burner 14, while generally not subjecting the heat exchanger 12 surfaces to direct effects of the combustion, to assist in preventing thermal damage to the heat exchanger 12.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A refractory panel for a burner assembly, comprising:

a body including a first planar surface having a plurality of refractory openings formed therein, wherein each of the plurality of refractory openings is positionable in axial alignment with and downstream from a burner outlet, the body being receivable within an internal cavity of an inner box of the burner assembly such that a surface of the inner box and the first planar surface are in overlapping arrangement; and a sidewall arranged about a periphery of at least one of the plurality of refractory openings, the sidewall extending outwardly from the first planar surface and being configured to extend through an opening formed in the surface of the inner box and into an inlet of heat exchanger coil when the body is installed within the internal cavity; and wherein a portion of the sidewall configured to extend into an inlet of the heat exchanger coil bends inwardly towards a center of the opening.

2. The refractory panel according to claim 1, wherein the at least one sidewall is integrally formed with the first planar surface.

3. The refractory panel according to claim 1, wherein the body and at least one sidewall are formed via a vacuum molding process.

4. The refractory panel according to claim 1, wherein a size and shape of the refractory panel is generally complementary to the cavity of the inner box of the burner assembly.

5. The refractory panel according to claim 1, wherein the geometry of each refractory opening and sidewall is selected to encourage fluid flow towards the heat exchanger inlet.

6. The refractory panel according to claim 1, wherein the refractory panel is formed from a material configured to withstand a temperature of at least about 2300° F.

7. A furnace comprising:

a heat exchanger including a plurality of coils; and a burner assembly including:

one or more burners disposed at and substantially aligned with one or more burner openings of the heat exchanger;

a partition plate including one or more partition openings substantially aligned with the one or more burner openings of the heat exchanger;

an inner box including one or more cell openings substantially aligned with the one or more partition openings, wherein an inlet end of one or more of the heat exchanger coils is arranged in contact with a surface of the inner box, the inner box defining a cavity; and a refractory panel arranged downstream from the one or more burners generally between the partition plate and the inner box, within the cavity of the inner box, the refractory panel including one or more refractory openings substantially axially aligned with the one or more burners, the one or more partition openings, and the one or more cell openings, wherein a sidewall arranged about a periphery of the one or more refractory openings extends through an adjacent cell opening formed in the inner box into a corresponding coil of the plurality of coils, wherein a distal end of the sidewall includes a feature; and wherein a portion of the sidewall configured to extend into an inlet of the heat exchanger coil bends inwardly towards a center of the opening.

8. The furnace according to claim 7, wherein the sidewall extends into the inlet end of a heat exchanger coil.

9. The furnace according to claim 7, wherein the sidewall is integrally formed with a first planar surface of the refractory panel.

10. The furnace according to claim 9, wherein the refractory panel is formed via a vacuum molding process.

11. The furnace according to claim 7, wherein the refractory has a size and shape generally complementary to the cavity.

12. The furnace according to claim 7, wherein a geometry of the one or more refractory openings and sidewalls is selected to encourage fluid flow towards the inlet end of the heat exchanger coils.

13. The furnace according to claim 7, wherein the refractory panel is formed from a material configured to withstand a temperature of at least about 2300° F.

14. The furnace according to claim 7, wherein the one or more burners are configured to pre-mix fuel and air before ignition thereof.

* * * * *